US012409375B2

(12) United States Patent
Silcock et al.

(10) Patent No.: US 12,409,375 B2
(45) Date of Patent: Sep. 9, 2025

(54) SYSTEMS AND METHODS FOR HAPTIC SIMULATION IN INCLINE EXERCISE DEVICES

(71) Applicant: iFIT Inc., Logan, UT (US)

(72) Inventors: Ryan Silcock, Logan, UT (US); Tyson Olsen, Logan, UT (US)

(73) Assignee: iFIT Inc., Logan, UT (US)

( * ) Notice: Subject to any disclaimer, the term of this patent is extended or adjusted under 35 U.S.C. 154(b) by 203 days.

(21) Appl. No.: 18/123,026

(22) Filed: Mar. 17, 2023

(65) Prior Publication Data

US 2023/0293963 A1 Sep. 21, 2023

Related U.S. Application Data

(60) Provisional application No. 63/321,303, filed on Mar. 18, 2022.

(51) Int. Cl.
*A63B 71/06* (2006.01)
*A63B 24/00* (2006.01)

(52) U.S. Cl.
CPC ..... *A63B 71/0619* (2013.01); *A63B 24/0087* (2013.01); *A63B 2024/009* (2013.01); *A63B 2071/0655* (2013.01); *A63B 2225/093* (2013.01); *A63B 2225/66* (2013.01)

(58) Field of Classification Search
CPC ..... A63B 22/0015; A63B 22/0023; A63B 22/0046; A63B 22/02; A63B 22/0605; A63B 24/0087; A63B 2225/09; A63B 2225/093; A63B 2225/66
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell |
| 4,630,839 | A | 12/1986 | Seol |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout et al. |
| D304,849 | S | 11/1989 | Watterson |
| 4,880,225 | A | 11/1989 | Lucas et al. |

(Continued)

OTHER PUBLICATIONS

U.S. Appl. No. 29/702,127, filed Sep. 16, 2019, Cutler et al.

(Continued)

*Primary Examiner* — Gary D Urbiel Goldner
(74) *Attorney, Agent, or Firm* — Holland & Hart LLP

(57) ABSTRACT

A haptic simulation exercise device includes a frame, a base supporting the frame, and an incline motor. The incline motor is configured to move the frame relative to the base to provide haptic simulation during a workout routine. An actuator moves the frame faster than the incline motor to simulate outdoor conditions during a workout routine.

10 Claims, 5 Drawing Sheets

(56) References Cited

U.S. PATENT DOCUMENTS 4,883,272 A 11/1989 Lay
D306,468 S 3/1990 Watterson
D306,891 S 3/1990 Watterson
4,913,396 A 4/1990 Dalebout et al.
D307,614 S 5/1990 Bingham
D307,615 S 5/1990 Bingham
4,921,242 A 5/1990 Watterson
4,932,650 A 6/1990 Bingham et al.
D309,167 S 7/1990 Griffin
D309,485 S 7/1990 Bingham
4,938,478 A 7/1990 Lay
D310,253 S 8/1990 Bersonnet
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout
5,013,033 A 5/1991 Watterson et al.
5,014,980 A 5/1991 Bersonnet et al.
5,016,871 A 5/1991 Dalebout et al.
D318,085 S 7/1991 Jacobson
D318,086 S 7/1991 Bingham
D318,699 S 7/1991 Jacobson
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout
D323,198 S 1/1992 Dalebout
D323,199 S 1/1992 Dalebout
D323,863 S 2/1992 Watterson
5,085,426 A * 2/1992 Wanzer ..... A63B 22/02 482/54
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,163,885 A * 11/1992 Wanzer ..... A63B 22/02 482/54
5,171,196 A 12/1992 Lynch
D332,347 S 1/1993 Raadt
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel
D335,905 S 5/1993 Cutter
D336,498 S 6/1993 Engel
5,217,487 A 6/1993 Engel et al.
D337,361 S 7/1993 Engel
D337,666 S 7/1993 Peterson
D337,799 S 7/1993 Cutter
5,226,866 A 7/1993 Engel et al.
5,244,446 A 9/1993 Engel et al.
5,247,853 A 9/1993 Dalebout
5,256,115 A * 10/1993 Scholder ..... A63B 22/0605 601/36
5,259,611 A 11/1993 Dalebout et al.
D342,106 S 12/1993 Campbell
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic
5,336,142 A 8/1994 Dalebout et al.
5,344,376 A 9/1994 Bostic et al.
D351,202 S 10/1994 Bingham
D351,435 S 10/1994 Peterson
D351,633 S 10/1994 Bingham
D352,534 S 11/1994 Dreibelbis
D353,422 S 12/1994 Bostic
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith
5,409,435 A 4/1995 Daniels
5,429,563 A 7/1995 Engel
5,431,612 A 7/1995 Holden
D360,915 S 8/1995 Bostic
5,468,205 A 11/1995 McFall
5,489,249 A 2/1996 Brewer
5,492,517 A 2/1996 Bostic
D367,689 S 3/1996 Wilkinson
5,511,740 A 4/1996 Loubert
5,512,025 A 4/1996 Dalebout
D370,949 S 6/1996 Furner
D371,176 S 6/1996 Furner
5,527,245 A 6/1996 Dalebout
5,529,553 A 6/1996 Finlayson
5,540,429 A 7/1996 Dalebout
5,549,533 A 8/1996 Olson
5,554,085 A 9/1996 Dalebout
5,569,128 A 10/1996 Dalebout
5,591,105 A 1/1997 Dalebout
5,591,106 A 1/1997 Dalebout
5,595,556 A 1/1997 Dalebout
5,607,375 A 3/1997 Dalebout
5,611,539 A 3/1997 Watterson
5,622,527 A 4/1997 Watterson
5,626,538 A 5/1997 Dalebout
5,626,542 A 5/1997 Dalebout
D380,024 S 6/1997 Novak
5,637,059 A 6/1997 Dalebout
D380,509 S 7/1997 Wilkinson
5,643,153 A 7/1997 Nylen
5,645,509 A 7/1997 Brewer
D384,118 S 9/1997 Deblauw
5,662,557 A 9/1997 Watterson
5,669,857 A 9/1997 Watterson
5,672,140 A 9/1997 Watterson
5,674,156 A 10/1997 Watterson
5,674,453 A 10/1997 Watterson
5,676,624 A 10/1997 Watterson
5,683,331 A 11/1997 Dalebout
5,683,332 A 11/1997 Watterson
D387,825 S 12/1997 Fleck
5,695,433 A 12/1997 Buisman
5,695,434 A 12/1997 Dalebout
5,695,435 A 12/1997 Dalebout
5,702,325 A 12/1997 Watterson
5,704,879 A 1/1998 Watterson
5,718,657 A 2/1998 Dalebout et al.
5,720,200 A 2/1998 Anderson
5,720,698 A 2/1998 Dalebout

(56) References Cited

U.S. PATENT DOCUMENTS

D392,006 S 3/1998 Dalebout
5,722,922 A 3/1998 Watterson
5,733,229 A 3/1998 Dalebout
5,743,833 A 4/1998 Watterson
5,762,584 A 6/1998 Daniels
5,762,587 A 6/1998 Dalebout
5,772,560 A 6/1998 Watterson
5,810,698 A 9/1998 Hullett
5,827,155 A 10/1998 Jensen
5,830,114 A 11/1998 Halfen
5,860,893 A 1/1999 Watterson
5,860,894 A 1/1999 Dalebout
5,899,834 A 5/1999 Dalebout
D412,953 S 8/1999 Armstrong
D413,948 S 9/1999 Dalebout
5,951,441 A 9/1999 Dalebout
5,951,448 A 9/1999 Bolland
5,961,424 A 10/1999 Warner et al.
D416,596 S 11/1999 Armstrong
6,003,166 A 12/1999 Hald
6,019,710 A 2/2000 Dalebout
6,027,429 A 2/2000 Daniels
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris
6,422,980 B1 7/2002 Simonson
6,447,424 B1 9/2002 Ashby et al.
6,458,060 B1 10/2002 Watterson
6,458,061 B2 10/2002 Simonson
6,471,622 B1 10/2002 Hammer
6,563,225 B2 5/2003 Soga
6,572,512 B2 * 6/2003 Anderson ..... A63B 22/0207 482/54
6,601,016 B1 7/2003 Brown
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson
6,701,271 B2 3/2004 Willner
6,702,719 B1 3/2004 Brown
6,712,740 B2 3/2004 Simonson
6,730,002 B2 5/2004 Hald
6,743,153 B2 6/2004 Watterson
6,746,371 B1 6/2004 Brown
6,749,537 B1 6/2004 Hickman
6,761,667 B1 7/2004 Cutler et al.
6,770,015 B2 8/2004 Simonson
6,786,852 B2 9/2004 Watterson
6,808,472 B1 10/2004 Hickman
6,821,230 B2 11/2004 Dalebout
6,830,540 B2 12/2004 Watterson
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,921,351 B1 7/2005 Hickman
6,974,404 B1 12/2005 Watterson
6,997,852 B2 2/2006 Watterson
7,025,713 B2 4/2006 Dalebout
D520,085 S 5/2006 Willardson
7,044,897 B2 5/2006 Myers
7,052,442 B2 5/2006 Watterson
7,060,006 B1 6/2006 Watterson
7,060,008 B2 6/2006 Watterson et al.
7,070,539 B2 7/2006 Brown
7,097,588 B2 8/2006 Watterson
D527,776 S 9/2006 Willardson
7,112,168 B2 9/2006 Dalebout et al.
7,128,693 B2 10/2006 Brown
7,166,062 B1 1/2007 Watterson
7,166,064 B2 1/2007 Watterson
7,169,087 B2 1/2007 Ercanbrack
7,169,093 B2 1/2007 Simonson
7,192,388 B2 3/2007 Dalebout
7,250,022 B2 7/2007 Dalebout
7,282,016 B2 10/2007 Simonson
7,285,075 B2 10/2007 Cutler
7,344,481 B2 3/2008 Watterson
7,377,882 B2 5/2008 Watterson
7,425,188 B2 9/2008 Ercanbrack
7,429,236 B2 9/2008 Dalebout
7,455,622 B2 11/2008 Watterson
7,482,050 B2 1/2009 Olson
D588,655 S 3/2009 Utykanski
7,510,509 B2 3/2009 Hickman
7,537,546 B2 5/2009 Watterson
7,537,549 B2 5/2009 Nelson
7,537,552 B2 5/2009 Dalebout
7,540,828 B2 6/2009 Watterson
7,549,947 B2 6/2009 Hickman
7,556,590 B2 7/2009 Watterson et al.
7,563,203 B2 7/2009 Dalebout
7,575,536 B1 8/2009 Hickman
7,601,105 B1 10/2009 Gipson, III
7,604,573 B2 10/2009 Dalebout
D604,373 S 11/2009 Dalebout
7,618,350 B2 11/2009 Dalebout
7,618,357 B2 11/2009 Dalebout
7,625,315 B2 12/2009 Hickman
7,625,321 B2 12/2009 Simonson
7,628,730 B1 12/2009 Watterson
7,628,737 B2 12/2009 Kowallis
7,637,847 B1 12/2009 Hickman
7,645,212 B2 1/2010 Ashby et al.
7,645,213 B2 1/2010 Watterson
7,658,698 B2 2/2010 Pacheco
7,674,205 B2 3/2010 Dalebout
7,713,171 B1 5/2010 Hickman
7,713,172 B2 5/2010 Watterson
7,713,180 B2 5/2010 Wickens
7,717,828 B2 5/2010 Simonson
7,736,279 B2 6/2010 Dalebout
7,740,563 B2 6/2010 Dalebout
7,749,144 B2 7/2010 Hammer
7,766,797 B2 8/2010 Dalebout
7,771,329 B2 8/2010 Dalebout
7,775,940 B2 8/2010 Dalebout
7,789,800 B1 9/2010 Watterson
7,798,946 B2 9/2010 Dalebout
7,815,550 B2 10/2010 Watterson
7,857,731 B2 12/2010 Hickman
7,862,475 B2 1/2011 Watterson
7,862,478 B2 1/2011 Watterson
7,862,483 B2 1/2011 Hendrickson
D635,207 S 3/2011 Dalebout
7,901,330 B2 3/2011 Dalebout
7,909,740 B2 3/2011 Dalebout
7,914,420 B2 * 3/2011 Daly ..... A63B 24/00 482/901
7,980,996 B2 7/2011 Hickman
7,981,000 B2 7/2011 Watterson
7,985,164 B2 7/2011 Ashby

(56) References Cited

U.S. PATENT DOCUMENTS

| | | | |
|---|---|---|---|
| 8,029,415 | B2 | 10/2011 | Ashby et al. |
| 8,033,960 | B1 | 10/2011 | Dalebout |
| D650,451 | S | 12/2011 | Olson |
| D652,877 | S | 1/2012 | Dalebout |
| 8,152,702 | B2 | 4/2012 | Pacheco |
| D659,775 | S | 5/2012 | Olson |
| D659,777 | S | 5/2012 | Watterson |
| D660,383 | S | 5/2012 | Watterson |
| D664,613 | S | 7/2012 | Dalebout |
| 8,251,874 | B2 | 8/2012 | Ashby |
| 8,298,123 | B2 | 10/2012 | Hickman |
| 8,298,125 | B2 | 10/2012 | Colledge |
| D671,177 | S | 11/2012 | Sip |
| D671,178 | S | 11/2012 | Sip |
| D673,626 | S | 1/2013 | Olson |
| 8,690,735 | B2 | 4/2014 | Watterson |
| D707,763 | S | 6/2014 | Cutler |
| 8,740,753 | B2 | 6/2014 | Olson |
| 8,758,201 | B2 | 6/2014 | Ashby |
| 8,771,153 | B2 | 7/2014 | Dalebout |
| 8,784,270 | B2 | 7/2014 | Watterson |
| 8,808,148 | B2 | 8/2014 | Watterson |
| 8,814,762 | B2 | 8/2014 | Butler |
| D712,493 | S | 9/2014 | Ercanbrack |
| 8,840,075 | B2 | 9/2014 | Olson |
| 8,845,493 | B2 | 9/2014 | Watterson |
| 8,870,726 | B2 | 10/2014 | Watterson |
| 8,876,668 | B2 | 11/2014 | Hendrickson |
| 8,894,549 | B2 | 11/2014 | Colledge |
| 8,894,555 | B2 | 11/2014 | Olson |
| 8,911,330 | B2 | 12/2014 | Watterson |
| 8,920,288 | B2 | 12/2014 | Dalebout |
| 8,986,165 | B2 | 3/2015 | Ashby |
| 8,992,364 | B2 | 3/2015 | Law |
| 8,992,387 | B2 | 3/2015 | Watterson |
| D726,476 | S | 4/2015 | Ercanbrack |
| 9,028,368 | B2 | 5/2015 | Ashby |
| 9,028,370 | B2 | 5/2015 | Watterson |
| 9,039,578 | B2 | 5/2015 | Dalebout |
| D731,011 | S | 6/2015 | Buchanan |
| 9,072,930 | B2 | 7/2015 | Ashby |
| 9,119,983 | B2 | 9/2015 | Rhea |
| 9,123,317 | B2 | 9/2015 | Watterson |
| 9,126,071 | B2 | 9/2015 | Smith |
| 9,126,072 | B2 | 9/2015 | Watterson |
| 9,138,615 | B2 | 9/2015 | Olson |
| 9,142,139 | B2 | 9/2015 | Watterson |
| 9,144,703 | B2 | 9/2015 | Dalebout |
| 9,149,683 | B2 | 10/2015 | Watterson et al. |
| 9,186,535 | B2 | 11/2015 | Ercanbrack |
| 9,186,549 | B2 | 11/2015 | Watterson |
| 9,254,409 | B2 | 2/2016 | Dalebout |
| 9,254,416 | B2 | 2/2016 | Ashby |
| 9,278,248 | B2 | 3/2016 | Tyger |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson |
| 9,352,186 | B2 | 5/2016 | Watterson |
| 9,375,605 | B2 | 6/2016 | Tyger |
| 9,381,394 | B2 | 7/2016 | Mortensen |
| 9,387,387 | B2 | 7/2016 | Dalebout |
| 9,393,453 | B2 | 7/2016 | Watterson |
| 9,403,047 | B2 | 8/2016 | Olson |
| 9,403,051 | B2 | 8/2016 | Cutler |
| 9,421,416 | B2 | 8/2016 | Mortensen |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen |
| 9,498,668 | B2 | 11/2016 | Smith |
| 9,517,378 | B2 | 12/2016 | Ashby |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout |
| 9,586,090 | B2 | 3/2017 | Watterson |
| 9,604,099 | B2 | 3/2017 | Taylor |
| 9,616,276 | B2 | 4/2017 | Dalebout |
| 9,616,278 | B2 | 4/2017 | Olson |
| 9,623,281 | B2 | 4/2017 | Hendrickson |
| 9,636,567 | B2 | 5/2017 | Brammer |
| 9,675,839 | B2 | 6/2017 | Dalebout |
| 9,682,307 | B2 | 6/2017 | Dalebout |
| 9,694,234 | B2 | 7/2017 | Dalebout |
| 9,694,242 | B2 | 7/2017 | Ashby |
| 9,707,443 | B2 | 7/2017 | Warren |
| 9,737,755 | B2 | 8/2017 | Dalebout |
| 9,757,605 | B2 | 9/2017 | Olson |
| 9,764,186 | B2 | 9/2017 | Dalebout |
| 9,767,785 | B2 | 9/2017 | Ashby |
| 9,795,822 | B2 | 10/2017 | Smith |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby |
| 9,889,339 | B2 | 2/2018 | Douglass |
| 9,937,376 | B2 | 4/2018 | McInelly |
| 9,937,377 | B2 | 4/2018 | McInelly |
| 9,937,378 | B2 | 4/2018 | Dalebout |
| 9,937,379 | B2 | 4/2018 | Mortensen |
| 9,943,719 | B2 | 4/2018 | Smith |
| 9,943,722 | B2 | 4/2018 | Dalebout |
| 9,948,037 | B2 | 4/2018 | Ashby |
| 9,968,816 | B2 | 5/2018 | Olson |
| 9,968,821 | B2 | 5/2018 | Finlayson |
| 9,968,823 | B2 | 5/2018 | Cutler |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack |
| D827,733 | S | 9/2018 | Hochstrasser |
| 10,065,064 | B2 | 9/2018 | Smith |
| 10,071,285 | B2 | 9/2018 | Smith |
| 10,085,586 | B2 | 10/2018 | Smith |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson |
| 10,207,143 | B2 | 2/2019 | Dalebout |
| 10,207,145 | B2 | 2/2019 | Tyger |
| 10,207,147 | B2 | 2/2019 | Ercanbrack |
| 10,207,148 | B2 | 2/2019 | Powell |
| 10,212,994 | B2 | 2/2019 | Watterson |
| 10,220,259 | B2 | 3/2019 | Brammer |
| 10,226,396 | B2 | 3/2019 | Ashby |
| 10,226,664 | B2 | 3/2019 | Dalebout |
| 10,252,109 | B2 | 4/2019 | Watterson |
| 10,258,828 | B2 | 4/2019 | Dalebout |
| 10,272,317 | B2 | 4/2019 | Watterson |
| 10,279,212 | B2 | 5/2019 | Dalebout |
| 10,293,211 | B2 | 5/2019 | Watterson |
| D852,292 | S | 6/2019 | Cutler |
| 10,343,017 | B2 | 7/2019 | Jackson |
| 10,376,736 | B2 | 8/2019 | Powell |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby |
| 10,441,840 | B2 | 10/2019 | Dalebout |
| 10,441,844 | B2 | 10/2019 | Powell |
| 10,449,416 | B2 | 10/2019 | Dalebout |
| 10,471,299 | B2 | 11/2019 | Powell |
| D868,909 | S | 12/2019 | Cutler |

(56) References Cited

U.S. PATENT DOCUMENTS 10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
10,625,114 B2 4/2020 Ercanbrack
10,625,137 B2 4/2020 Dalebout
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson
10,786,706 B2 9/2020 Smith
10,864,407 B2 12/2020 Watterson
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson
10,994,173 B2 5/2021 Watterson
11,000,730 B2 5/2021 Dalebout et al.
11,013,960 B2 5/2021 Watterson
11,033,777 B1 6/2021 Watterson et al.
11,058,913 B2 7/2021 Dalebout et al.
11,058,914 B2 7/2021 Powell
11,187,285 B2 11/2021 Wrobel
11,517,781 B1 * 12/2022 Whalen ..... A61G 10/023
11,534,654 B2 * 12/2022 Silcock ..... A63B 71/0622
2004/0002406 A1 * 1/2004 Lopez-Santillana ..... A63B 22/0235 482/54
2006/0199704 A1 * 9/2006 Lo ..... A63B 22/0023 482/54
2012/0088634 A1 * 4/2012 Heidecke ..... A63B 22/0005 482/92
2012/0178592 A1 7/2012 Chieh et al.
2013/0334001 A1 12/2013 Albrecht et al.
2014/0221167 A1 * 8/2014 Wu ..... A63B 22/0235 482/54
2014/0251709 A1 9/2014 Ruffieux
2016/0287930 A1 * 10/2016 Moser ..... A63B 24/0087
2017/0124912 A1 5/2017 Ashby et al.
2017/0193578 A1 7/2017 Watterson
2017/0266489 A1 9/2017 Douglass et al.
2017/0270820 A1 9/2017 Ashby et al.
2018/0043207 A1 * 2/2018 Moser ..... A63B 71/0622
2018/0085630 A1 3/2018 Capell et al.
2018/0099116 A1 4/2018 Ashby
2018/0099180 A1 4/2018 Wilkinson
2018/0111034 A1 4/2018 Watterson
2019/0058370 A1 2/2019 Tinney
2019/0223612 A1 7/2019 Watterson et al.
2019/0269971 A1 9/2019 Capell et al.
2019/0376585 A1 12/2019 Buchanan
2020/0009417 A1 1/2020 Dalebout
2020/0222751 A1 7/2020 Dalebout et al.
2020/0238130 A1 * 7/2020 Silcock ..... A63B 71/0622
2020/0254295 A1 8/2020 Watterson
2020/0254309 A1 8/2020 Watterson
2020/0254311 A1 8/2020 Watterson et al.
2020/0338389 A1 10/2020 Dalebout et al.
2020/0368575 A1 11/2020 Hays et al.
2020/0391069 A1 12/2020 Olson et al.
2021/0046351 A1 2/2021 Ercanbrack et al.
2021/0046352 A1 * 2/2021 Lopez Babodilla ..... A63B 22/0023
2021/0046353 A1 2/2021 Dalebout et al.
2021/0106899 A1 4/2021 Willardson et al.
2021/0110910 A1 4/2021 Ostler et al.
2021/0138332 A1 5/2021 Dalebout et al.
2021/0146191 A1 5/2021 Dalebout et al.
2021/0146221 A1 5/2021 Dalebout et al.
2021/0153463 A1 * 5/2021 Yoo ..... A01K 29/005
2021/0153464 A1 * 5/2021 Yoo ..... A63B 22/025
2021/0153465 A1 * 5/2021 Yoo ..... A61L 9/122
2021/0153466 A1 * 5/2021 Yoo ..... A63B 24/0087
2021/0153467 A1 * 5/2021 Yoo ..... A01K 5/02
2021/0153468 A1 * 5/2021 Yoo ..... A61L 2/10
2021/0153469 A1 * 5/2021 Yoo ..... A63B 21/4035
2021/0153470 A1 * 5/2021 Yoo ..... A63B 22/02
2021/0153471 A1 * 5/2021 Yoo ..... A63B 22/0292
2021/0153472 A1 * 5/2021 Yoo ..... A63B 24/0087
2021/0153473 A1 * 5/2021 Yoo ..... A61M 21/02
2021/0153474 A1 * 5/2021 Yoo ..... A63B 22/025
2021/0154524 A1 * 5/2021 Yoo ..... A63B 22/0023
2021/0154525 A1 * 5/2021 Yoo ..... A01K 15/027
2021/0154526 A1 * 5/2021 Yoo ..... A01K 15/027
2021/0161245 A1 6/2021 Ashby et al.
2021/0213331 A1 7/2021 Watterson
2021/0213332 A1 7/2021 Watterson et al.
2021/0220698 A1 7/2021 Dalebout et al.
2021/0252334 A1 * 8/2021 Lu ..... A63B 21/00069
2021/0268336 A1 9/2021 Watterson et al.
2021/0283465 A1 * 9/2021 Arceta ..... A63B 71/0622
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0023702 A1 1/2022 Watterson
2022/0062685 A1 3/2022 Ashby et al.
2022/0074455 A1 3/2022 Wrobel
2023/0191189 A1 * 6/2023 Taylor ..... A63B 22/02 482/54

OTHER PUBLICATIONS

U.S. Appl. No. 63/079,697, filed Sep. 7, 2020, Willardson et al.
U.S. Appl. No. 17/066,485, filed Oct. 9, 2020, Weston et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/200,903, filed Apr. 2, 2021, Watterson et al.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 17/462,687, filed Aug. 31, 2021, Ashby et al.
U.S. Appl. No. 63/073,081, filed Sep. 1, 2021, Ashby et al.
U.S. Appl. No. 17/476,899, filed Sep. 16, 2021, Willardson et al.
U.S. Appl. No. 17/492,104, filed Oct. 1, 2021, Ashby.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 17/568,882, filed Jan. 5, 2022, Ercanbrack et al.
U.S. Appl. No. 63/298,170, filed Jan. 10, 2022, Ercanbrack et al.
U.S. Appl. No. 63,299,357, filed Jan. 13, 2022, Toles et al.
U.S. Appl. No. 17/589,027, filed Jan. 31, 2022, Dalebout et al.
U.S. Appl. No. 17/589,075, filed Jan. 31, 2022, Ashby.

* cited by examiner

SYSTEMS AND METHODS FOR HAPTIC SIMULATION IN INCLINE EXERCISE DEVICES

CROSS REFERENCE TO RELATED APPLICATIONS

This application claims benefit and priority to U.S. Provisional Patent Application No. 63/321,303, filed on Mar. 18, 2023, which is incorporated herein in its entirety by reference.

BACKGROUND

Background and Relevant Art

Exercise devices simulate many of the aspects of outdoor exercises using a stationary device, which is conventionally used indoors as an alternative to the outdoor exercise. Exercise devices provide a controlled environment with improved safety and less distractions than the outdoor activities simulated by the exercise devices, such as bicycling, running, rowing, or hiking. Exercise devices allow the user to focus on efficiency, comfort, and convenience without the concerns of external factors.

In simulating the outdoor activity, an exercise device may present video and/or audio information of the outdoor activity, such as running on a beach or riding a bicycle on a dirt road, to the user. A disconnect exists, however, between what the user sees and hears in the presented video and audio information and what the user feels through their interaction with the exercise device.

BRIEF SUMMARY

In some embodiments, a haptic simulation exercise device includes a frame, a base supporting the frame, and an actuator. The actuator is configured to move the frame relative to the base to provide haptic simulation during a workout routine.

This Summary is provided to introduce a selection of concepts in a simplified form that are further described below in the Detailed Description. This Summary is not intended to identify key features or essential features of the claimed subject matter.

Additional features and advantages will be set forth in the description which follows, and in part will be obvious from the description, or may be learned by the practice of the teachings herein. Features and advantages of the disclosure may be realized and obtained by means of the instruments and combinations particularly pointed out in the appended claims. Features of the present disclosure will become more fully apparent from the following description and appended claims or may be learned by the practice of the disclosure as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
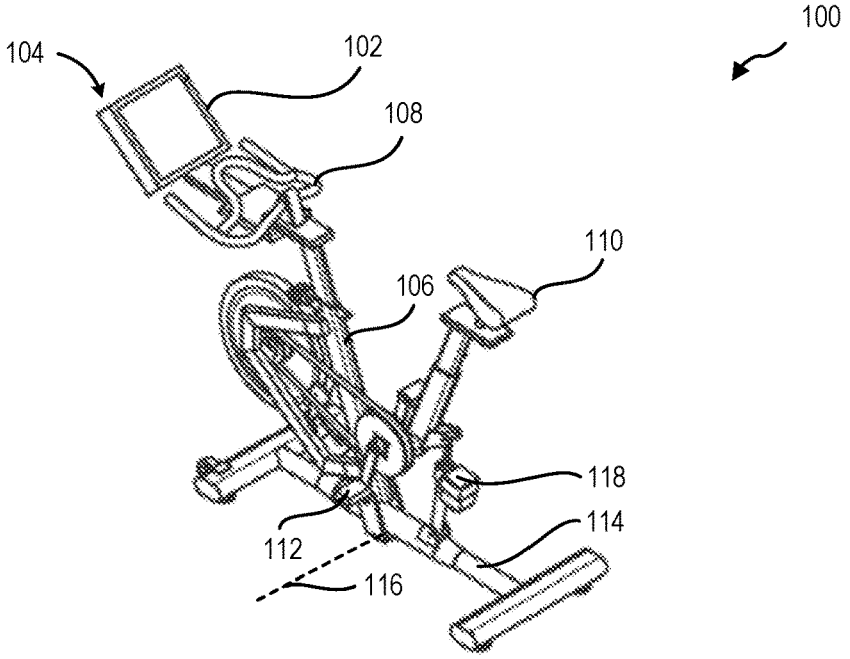
FIG. 1 is a perspective view of an exercise bicycle including haptic simulation, according to at least one embodiment of the present disclosure.

The present disclosure relates generally to systems and methods for haptic simulations in an exercise device. More particularly, the exercise devices of the present disclosure include a frame that is movable relative to a base of the exercise device to increase the user's immersion in a simulated environment.

An exercise device is any mechanical device that is used to provide or replicate a physical activity in a localized space. Exercise devices can include a treadmill, cable or spring resistance machine, weight resistance machine, dumbbells, elliptical machine, stepper machine, stationary bicycle, rowing machine, or any other machine or exercise device. In an example, it should be understood that while a road bicycle may not be an exercise device, as used herein, a bicycle positioned on a stationary trainer device should be considered an exercise device as the bicycle remains in one location while the user rides the bicycle on the stationary trainer device.

In some embodiments, an exercise device includes or is in communication with a display. The display allows a user of the exercise device to view video information as the user engages in exercises. In some embodiments, the display presents video information that simulates a route, path, track, road, trail, or other environment associated with the activity replicated by the exercise device. For example, a display integrated in or in communication with a treadmill may present video information simulating traveling down a road in Oahu, Hawaii at a speed approximately equal to the speed at which the tread belt is moving on the treadmill. The resulting experience for the user is a simulated run down the road presented on the display. Similarly, in another example, a display integrated in or in communication with a stationary bicycle may present video information simulating traveling down a mountain trail in Sedona, Arizona at a speed approximately equal to the speed at which the user moves the pedals of the stationary bicycle. The resulting experience for the user is a simulated mountain bike ride down the trail presented on the display. In yet another example, a display integrated in or in communication with a rowing machine may present video information simulating rowing down the Charles River in Cambridge, Massachusetts at a speed approximately equal to the speed at which the user pulls the handle of the rowing machine. The resulting experience for the user is a simulated row down the river presented on the display.

The exercise device simulates the experience based on simulation data that includes video information as described above. In some embodiments, the simulation data includes audio information. For example, the exercise device may offer one or more simulations such as simulate racing in a stage of a bike race or running away from a dinosaur. In such examples, audio information can increase the immersion of a bike race simulation by simulating cheering fans or sound of another racer approaching from behind on a climb. In another example, audio information can increase the immersion of a dinosaur chase by simulating the roar of the dinosaur behind the runner.

In some embodiments, the simulation data includes haptic information. In the previous examples, the exercise device offers simulations that simulate racing in a stage of a bike race or running away from a dinosaur. In such examples, haptic information can increase the immersion of a bike race simulation by rapidly changing inclination of a frame of the exercise bicycle relative to a base of the exercise bicycle simulate the cobblestone road surface of the Paris-Roubaix bicycle race. In another example, haptic information can increase the immersion of the dinosaur chase by rapidly changing the inclination of the tread belt of the treadmill to simulate the ground shaking with the dinosaur footsteps.

The haptic information may be predetermined and stored on a hardware storage device with the video and/or audio information of the simulation data. In some embodiments, the haptic information may be calculated by the exercise device, a client device, or a workout server based on the video information. For example, a recorded video of a mountain bike ride from a rider's viewpoint (such as video information recorded by a GoPro® or other action camera) may include the bicycle handlebars within the frame of the video information. In some embodiments, the system detects the location of the handlebars in the video information and determines the movement of the handlebars relative to the trail surface. The movement of the handlebars may be presented to the exercise device as haptic information and allow the exercise device to simulate the movement of the handlebars in the video information by moving the handlebars of the stationary bicycle relative to a frame of the stationary bicycle.

FIG. 1 is a perspective view of an exercise device 100, according to some embodiments of the present disclosure. The embodiment of an exercise device 100 in FIG. 1 is a stationary bicycle with a display 102 integrated into the exercise device 100. In some embodiments, the display 102 may be independent from, but in data communication with, the exercise device 100 and receive video information from a computing device 104 of the exercise device 100. The computing device 104 includes a processor and a hardware storage device with instructions stored thereon that, when executed by the processor, cause the exercise device 100 to perform any of the methods described herein.

In some embodiments, the hardware storage device is any non-transient computer readable medium that may store instructions thereon. The hardware storage device may be any type of solid-state memory; volatile memory, such as static random access memory (SRAM) or dynamic random access memory (DRAM); or non-volatile memory, such as read-only memory (ROM) including programmable ROM (PROM), erasable PROM (ERPOM) or EEPROM; magnetic storage media, such as magnetic tape; platen-based storage device, such as hard disk drives; optical media, such as compact discs (CD), digital video discs (DVD), Blu-ray Discs, or other optical media; removable media such as USB drives; non-removable media such as internal SATA or non-volatile memory express (NVMe) style NAND flash memory, or any other non-transient storage media. In some embodiments, the hardware storage device is local to and/or integrated with the computing device. In some embodiments, the hardware storage device is accessed by the computing device through a network connection.

The exercise device 100 includes one or more contact points supported by a frame 106 with which the user touches, contacts, or engages with the exercise device 100 during the exercise. It should be understood that while the user may touch or contact one or more controls of the exercise device 100, such as a touchscreen of the display 102 or other input devices to provide inputs to the computing device 104 (e.g., volume controls, resistance levels, power buttons), the controls or input devices are not considered the contact points of the exercise device 100 for the purposes of the exercise performed on the exercise device 100. In the embodiment illustrated in FIG. 1, the exercise device 100 is a stationary bicycle and the intended exercise of the stationary bicycle is cycling, therefor, the components of the stationary bicycle used for cycling are considered to be the contact points of the exercise device 100. The contact points of the exercise device 100 include the handlebars 108, the saddle 110, and the pedals 112.

In some embodiments, the frame 106 moves relative to a base 114 at a pivot 116. By moving the frame 106 relative to the base 114, the exercise device 100 can provide haptic feedback and/or simulations to the user by moving one or more contact points of the exercise device 100. In some embodiments, the contact points all move together to simulate, for example, a bicycle moving over a surface. In other embodiments, at least one contact point moves relative to another contact point, such as moving handlebars 108 relative to a seat or saddle 110. In some embodiments, the rotation of the frame 106 around the pivot 116 can simulate cobblestones, washboard roads, mountain bike trails, etc. on an exercise bicycle. In other embodiments, the rotation of the frame 106 can simulate other real-world experiences for other exercise devices, such as rough water on a stationary rower exercise device or rocky running trails on a treadmill exercise device.

In some embodiments, the frame 106 is movable relative to the base 114 by one or more incline motors 118. The incline motor 118 applies a torque around the pivot 116 to rotate the frame 106 relative to the base 114. In some embodiments, the incline motor 118 includes gears, worm gears, pinions, etc. to mechanically apply the torque around the pivot 116. In some embodiments, the incline motor 118 includes a piston-and-cylinder with a pressurized fluid therein to apply pneumatically or hydraulically apply the torque around the pivot 116. In some embodiments, the incline motor 118 includes an electromagnetic motor to move the frame 106 relative to the base 114.

The incline motor(s) 118 is in data communication with the computing device 104 to move the frame 106 relative to the base 114 in response to simulation data. In some embodiments, the computing device 104 has stored thereon instruction that, when executed by the computing device 104, cause the exercise device 100 to perform any of the methods described herein. In some embodiments, the computing device 104 communicates with the incline motor 118 to move the frame 106 relative to the base by moving at least a portion of the incline motor 118 at a rate of 5 millimeters per second. In contrast to conventional incline motors, an incline motor 118, according to the present, disclosure is configured to move the frame 106 rapidly and for a period of time at least 5 seconds in duration. For example, a conventional incline motor moves the frame 106 relative to the base 114 slowly and smoothly to provide gradual changes in inclination of the running surface (e.g., treadmill) or inclination of a bicycle frame to replicate riding a hill. However, there is no mechanism by which a conventional incline motor produces rapid, sustained movement to provide haptic simulations to a user.

Figure 2:
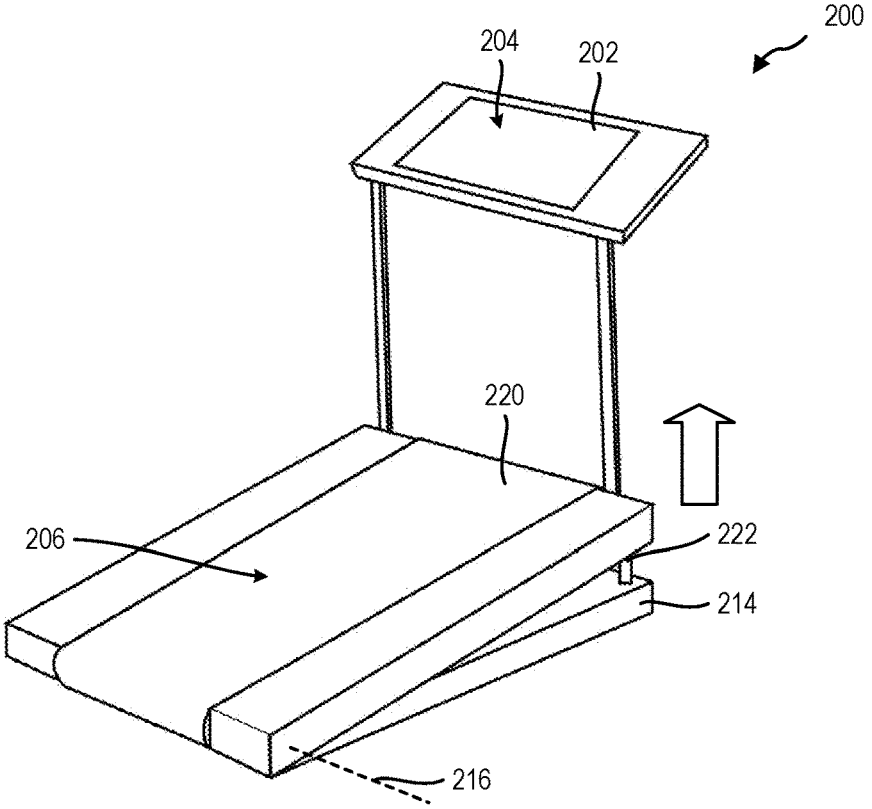
FIG. 2 is a perspective view of a treadmill including haptic simulation, according to at least one embodiment of the present disclosure.

FIG. 2 is a perspective view of another embodiment of an exercise device 200 configured to provide haptic simulations for a user. In some embodiments, a treadmill exercise device 200 has a display 202 and computing device 204 in communication therewith to provide exercise routines and video information to a user. The exercise device 200 has a tread belt 220 supported by a frame 206 that is movable relative to a base 214 of the exercise device 200. As described herein, the computing device 204 may move the frame 206, and, hence, contact points such as the tread belt 220, relative to the base 214 to produce a haptic simulation for the user. In some embodiments, the frame 206 is movable relative to the base 214 around a pivot 216 by an incline motor. In some embodiments, the incline motor is used to provide haptic simulation through rapid and/or sustained movement of the frame 206. In other embodiments, the incline motor provides slow and/or smooth changes in inclination of the frame 206 relative to the base 214 to simulate the overall angle of a running surface, while an actuator 222 is additionally provided to move the frame 206 relative to the base 214.

In some embodiments, the actuator 222 is connected to the incline motor, as will be described in greater detail herein, to move the frame 206 relative to the incline motor (or move the frame 206 and incline motor relative to the base 214). For example, the incline motor and actuator 222 may be connected in sequence to allow the incline motor to provide macro changes in the position of the frame 206 relative to the base 214, while the actuator 222 provides smaller, but more rapid, changes in the position of the frame 206 relative to the base 214.

In some embodiments, the exercise device 200 includes a single actuator 222. In other embodiments, the exercise device 200 includes a plurality of actuators 222. Each of the actuators 222 can include one or more individual actuatable devices, such as including a pair of actuatable devices to allow movement of the frame 206 in one or more directions or axes relative to the base 214. In some embodiments, the actuators 222 are electromagnetic actuators that use permanent magnets, electromagnets, or combinations thereof to apply magnetic force to move the frame 206 in one or more directions or axes relative to the base 214. In some embodiments, the actuators 222 are fluid piston actuators that use compressible or incompressible fluid in a cylinder to apply a force to a piston that is slidable relative to the cylinder. The fluid may be a gas (e.g., pneumatic piston and cylinder) or a liquid (e.g., hydraulic piston and cylinder) that moves piston relative to the cylinder to move the frame 206 in one or more directions or axes relative to the base 214. In some embodiments, the actuators 222 are mechanical actuators that use gears, springs, elastic or biasing elements, or combinations thereof to apply a compression and/or tension force to move the frame 206 in one or more directions or axes relative to the base 214.

In different embodiments, the actuators 222 move the contact points in different path directions and/or shapes. In some embodiments, an actuator 222 moves the frame 206 around the pivot 216 relative to the base 214 to move at least a portion of the tread belt 220 in an arcuate path. In other embodiments, the actuator 222 can move the frame 206 in a linear path relative to the base 214. For example, one or more actuators 222 may move the frame 206 vertically. In another example, one or more actuators 222 may move the frame 206 horizontally.

The actuators 222 move in response to the simulation data provided by the computing device 204. The simulation data includes haptic information that instructs one or more actuators 222 to move a contact point coordinated with audio and/or video information of the simulation data that is presented to the user on the display 202 or other audiovisual devices (e.g., speakers or headphones). The haptic information may include instructions for one or more actuators 222 to move the frame 206 a nominal or relative (to a total range of motion) amount, at a particular speed, for a particular duration, or combination thereof.

For example, the haptic information may instruct the actuator 222 to move the tread belt 220 in coordination with a tree stump presented on the display 202. The haptic information may instruct the actuator 222 at a 3:26 timestamp to translate the tread belt 220 upward by 35 millimeters (mm) at a rate of 100 millimeters per second (mm/s) and return the tread belt 220 to the original position at a rate of 50 mm/s. The higher rate of upward travel and the lower rate of downward travel may replicate an asymmetry of the tree stump in the video information.

In other examples, the entire surface of the tread belt 220 may displace upward before returning to the original position to simulate an explosion in the video information presented on the display 202. In at least one example, the exercise device 200 may simulate an action scene and prompt the user of the exercise device 200 to run to safety by evading objects and/or clearing obstacles in the presented video and/or audio information. The action scene may simulate escaping a boobytrapped temple where the user must run along uneven pathways, crumbling walls, and escape a large boulder following the user. The actuator(s) 222 may move the frame 206 around the pivot 216 to simulate the debris from the walls on the running surface and simulate the shaking of the ground as the boulder rolls behind the user.

Figure 3:
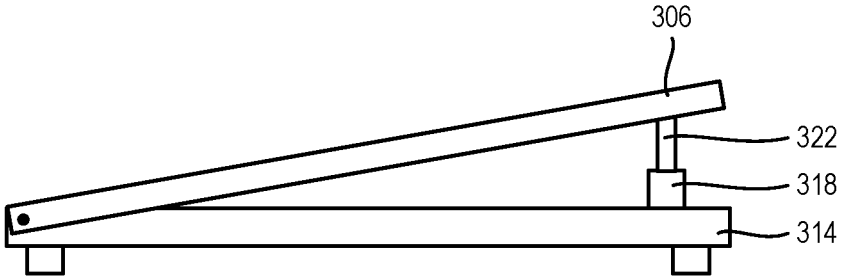
FIG. 3 is a side view of an exercise device with an incline motor and actuator in series, according to at least one embodiment of the present disclosure.

FIG. 3 is a side view of an embodiment of an actuator 322 and incline motor 318 connected in sequence to provide a cumulative displacement of a frame 306 relative to a base 314.

The range of motion of the actuator 322 and a range of motion of the connection point of the frame 306 movable by the actuator 322 may be different. For example, the actuator may be connected to the frame (e.g., the actuator 322 that moves the frame 306) by being coupled to a linkage or lever that moves the frame. In other examples, the range of motion of the actuator and a range of motion of the frame movable by the actuator may be equal, as the actuator and the frame are directly coupled to one another.

In some embodiments, the incline motor 318 has a range of motion that is greater than the actuator 322. In some embodiments, the actuator 322 moves the frame 306 relative to the base 314 faster than the incline motor 318.

In some embodiments, the range of motion of the frame is in a range having an upper value, a lower value, or upper and lower values including any of 5 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, or any values therebetween. In some examples, the range of motion of the connection point is greater than 5 mm. In other examples, the range of motion of the connection point is less than 100 mm. In yet other examples, the range of motion of the connection point is between 5 mm and 100 mm. In yet other examples, the range of motion of the connection point is between 10 mm and 80 mm. In yet other examples, the range of motion of the connection point is about 50 mm.

In some embodiments, the maximum rate of motion of the connection point of the frame is in a range having an upper value, a lower value, or upper and lower values including any of 25 mm/s, 50 mm/s, 100 mm/s, 150 mm/s, 200 mm/s, 250 mm/s, 300 mm/s, 350 mm/s, 400 mm/s, 450 mm/s, 500 mm/s, 550 mm/s, 600 mm/s, 650 mm/s, 700 mm/s, 750 mm/s, 800 mm/s, 850 mm/s, 900 mm/s, 950 mm/s, 1000 mm/s, or any values therebetween. In some examples, the maximum rate of motion of the connection point is greater than 25 mm/s. In other examples, the maximum rate of motion of the connection point is less than 1000 mm/s. In yet other examples, the maximum rate of motion of the connection point is between 25 mm/s and 1000 mm/s. In yet other examples, the maximum rate of motion of the connection point is between 100 mm/s and 750 mm/s. In yet other examples, the maximum rate of motion of the connection point is greater than 500 mm/s.

In some embodiments, the actuator 322 moves the frame 306 relative to the base 314 faster than the incline motor 318, and the incline motor 318 has a larger range of motion than the actuator 322. As described herein, in some embodiments, the actuator 322 includes a magnetic actuator, such as a linear magnetic actuator or rotational magnetic actuator. In some embodiments, the actuator 322 includes a piston-and-cylinder actuator, such as a hydraulic or pneumatic piston-and-cylinder actuator. In some embodiments, the actuator 322 includes a mechanical actuator, such as a rack and pinion actuator.

In at least one embodiment, the incline motor has a heat sink that allows the incline motor 318 to move the frame relative to the base 314 faster or for longer durations than a conventional heat sink. In some embodiments, the heat sink is an active heat sink with active cooling, such as a fan, liquid cooling, a thermoelectric cooler (e.g., a Peltier-style cooler), or other active cooling mechanisms. In some embodiments, the heat sink is a passive heat sink, such as cooling fins, pins, rods, heat spreaders, vapor chambers, heat pipes, or other heat sinks that increase surface area and passively exhaust heat to the ambient atmosphere.

In some embodiments, the incline motor heat sink is configured to allow the incline motor 318 to operate at least at a 50% duty cycle. In some embodiments, the incline motor heat sink is configured to allow the incline motor 318 to operate at least at a 90% duty cycle. In some embodiments, the incline motor heat sink is configured to allow the incline motor 318 to operate at a 100% duty cycle.

In some embodiments, the incline motor heat sink is configured to dissipate at least 500 Watts per minute (W/min). In some embodiments, the incline motor heat sink is configured to dissipate at least 750 Watts per minute (W/min). In some embodiments, the incline motor heat sink is configured to dissipate at least 1000 Watts per minute (W/min).

Figure 4:
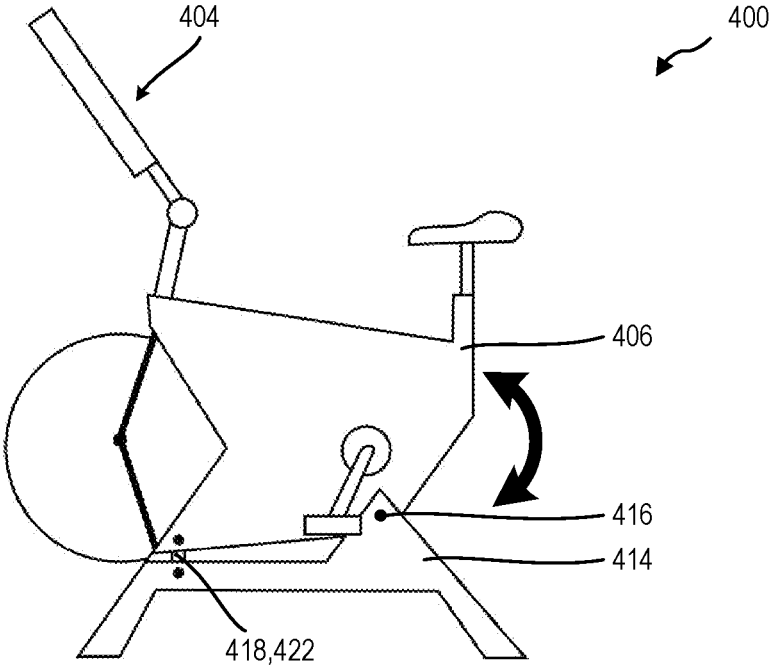
FIG. 4 is a side view of an exercise bicycle with an incline motor and actuator in series, according to at least one embodiment of the present disclosure.

FIG. 4 is a side view of another embodiment of an exercise device 400 with haptic simulation. The exercise device 400 includes an incline motor 418, and, optionally, an actuator 422, configured to move a frame 406 of the exercise device 400 relative to a base 414. The incline motor 418 and/or actuator 422 may move the frame 406 according to haptic information provided by the computing device 404. In some embodiments, the frame 406 is movable (e.g., tiltable) relative to a base 414 that contacts the ground. In some embodiments, the video information or workout routine includes global positioning satellite (GPS) location information or other location information. The location information may be compared to elevation or profile maps to determine an inclination or declination of the road or trail to be simulated by the tilt of the frame 406. The frame 406 may connect to the base 414 at a rotational pivot 416 that allows the frame 406 supporting the contact points to move relative to the ground. In some examples, an incline motor 418 provides macro-movements of the frame 406 around the pivot 416 to allow the exercise device 400 to simulate the angle of climbing up a road, while the incline motor 418 and actuator 422 provides smaller movements for haptic simulation to simulate the surface condition of the road. The computing device 404 may be in data communication with the actuator(s) 422 and incline motor 418 to tilt the frame 406 to provide a more immersive simulation.

While the movable frame 406 relative to the base 414 is described herein in relation to an exercise bicycle, it should be understood that a tiltable or movable frame with haptic simulation, where the frame is movable relative to a base, is applicable to other types of exercise devices, such as treadmills, rowing machines, and other devices.

Figure 5:
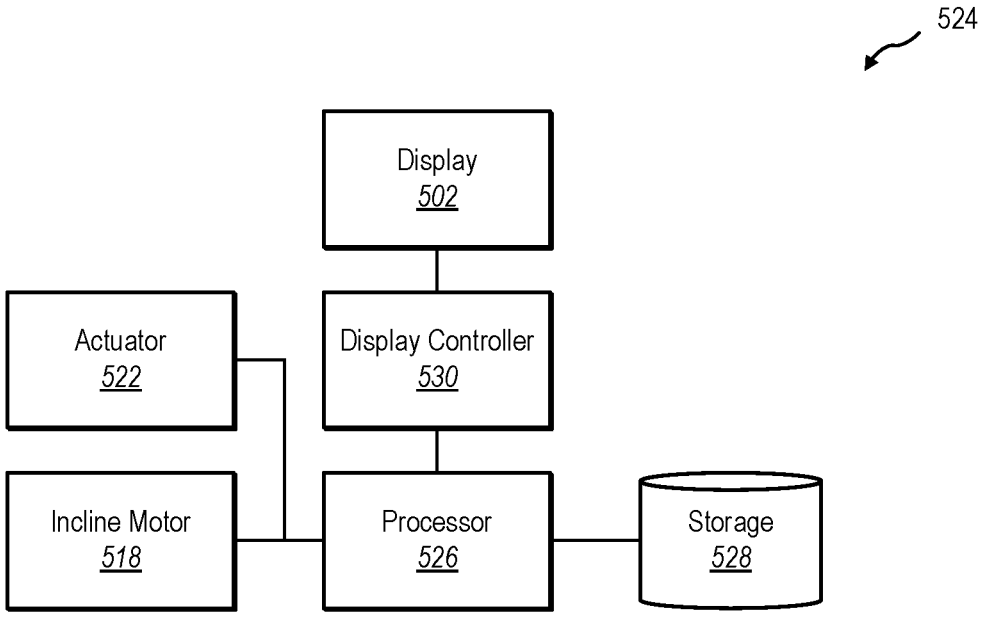
FIG. 5 is a system diagram of a system for controlling haptic simulation in an exercise device, according to at least one embodiment of the present disclosure.

An exercise device, according to the present disclosure, may include a plurality of electronic components in data communication. FIG. 5 is a schematic representation of an electronic system 524 of any exercise device described herein. The electronic system 524 includes a processor 526 and a hardware storage device 528. In some embodiments, the hardware storage device 528 is any non-transient computer readable medium that may store instructions thereon. The hardware storage device 528 may be any type of solid-state memory; volatile memory, such as static random access memory (SRAM) or dynamic random access memory (DRAM); or non-volatile memory, such as read-only memory (ROM) including programmable ROM (PROM), erasable PROM (ERPOM) or EEPROM; magnetic storage media, such as magnetic tape; platen-based storage device, such as hard disk drives; optical media, such as compact discs (CD), digital video discs (DVD), Blu-ray Discs, or other optical media; removable media such as USB drives; non-removable media such as internal SATA or non-volatile memory express (NVMe) style NAND flash memory, or any other non-transient storage media. In some embodiments, the hardware storage device 528 is local to and/or integrated with the processor 526. In some embodiments, the hardware storage device 528 is accessed by the processor 526 through a network connection.

The processor 526 is further in communication with a display controller 530. The processor 526 receives simulation data from the hardware storage device 528. In some embodiments, the simulation data includes video information and haptic information. The processor 526 transmits video information to the display controller 530 and instructions based on the haptic information to the incline motor 518 and/or the actuator 522. The display controller 530 communicates with the display 502 to present the video information to a user, while the incline motor 518 and/or the actuator 522 moves the frame of the exercise device relative to the base to provide haptic simulation to the user. The processor 526 may coordinate the presentation of the video information and haptic information to the user such that the user perceives the exercise device moving in coordination with the displayed video. In some embodiments, the processor 526 is further in communication with the one or more sensors and/or cameras to monitor the position and/or movement of the user. The processor 526 may transmit instructions or one or more actuators of a plurality of actuators based on the measurements from the sensors and/or cameras.

Figure 6:
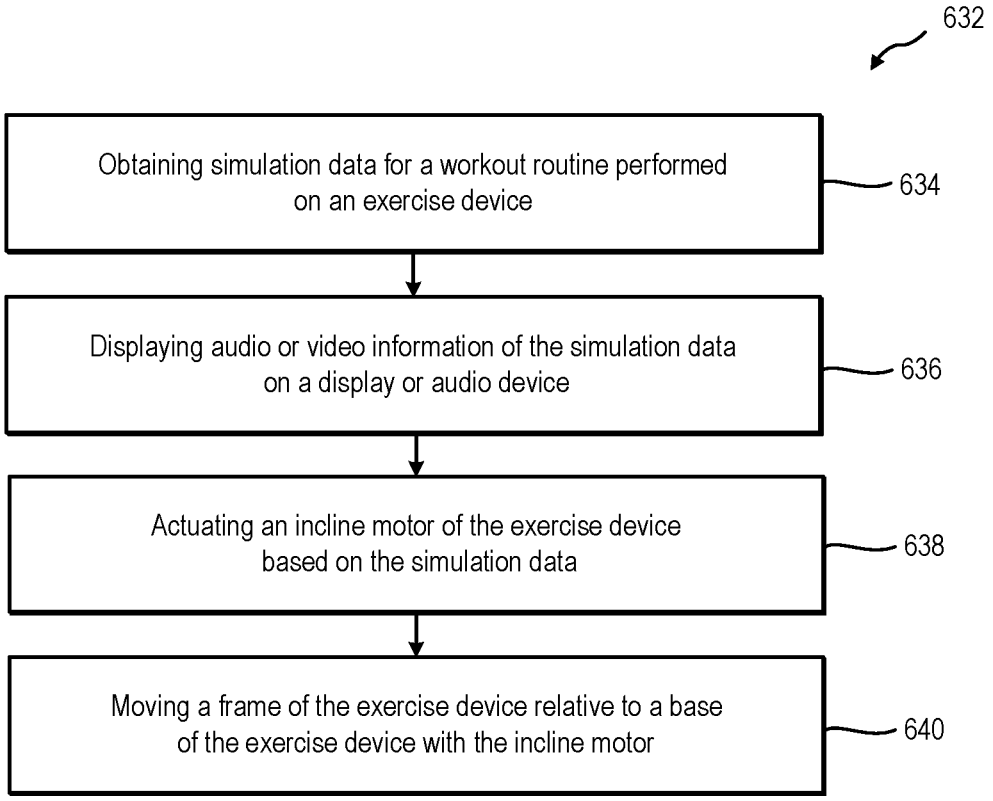
FIG. 6 is a flowchart illustrating a method of providing haptic simulation in an exercise device, according to at least one embodiment of the present disclosure.

FIG. 6 is a flowchart illustrating a method 632 of providing haptic simulation in an exercise device, according to some embodiments of the present disclosure. The method 632 includes obtaining simulation data for a workout routine performed on an exercise device at 634. In some embodiments, the simulation data is obtained from local hardware storage device. In some embodiments, the simulation data is obtained from a remote hardware storage device, such as by downloading or streaming the simulation data from a remote server or datacenter. A workout routine is a predetermined set of instructions that may be provided to a user. Following the workout routine can guide, entertain, or encourage the user through one or more exercises to produce workout information. The workout routine may include haptic information, video information, audio information, text information, still images, or combinations thereof to communicate the workout routine to the user.

The method 632 further includes displaying video information of the simulation data on a display (such as display 102 described in relation to FIG. 1) at 636. In some embodiments, the method 632 further includes playing audio information of the simulation data at 636. In some embodiments, the simulation data includes both audio information and video information. The audio and/or video information provides visual and/or auditory immersion to which the haptic simulation(s) add further immersion.

The haptic information of the simulation data is used in actuating an incline motor (and, optionally, an actuator) of the exercise device at 638, and the method 632 includes moving a frame of the exercise device relative to a base of the exercise device with incline motor (and, optionally, actuator) at 640. In some embodiments, the frame is further movable relative to the base to change an inclination or declination of the exercise device.

Figure 7:
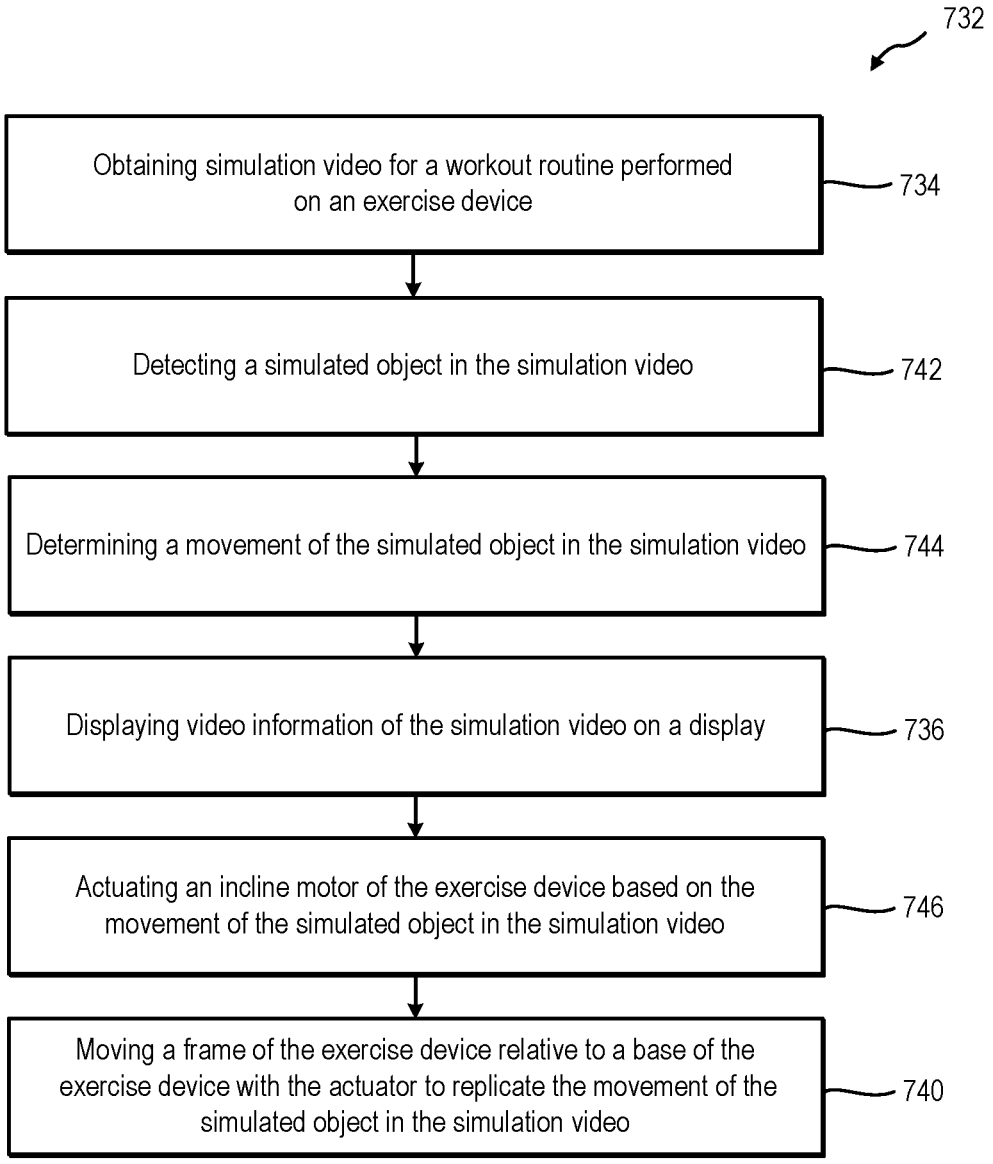
FIG. 7 is a flowchart illustrating another method of providing haptic simulation in an exercise device, according to at least one embodiment of the present disclosure.

While the method 632 includes actuating an actuator of the exercise device based on the simulation data, in some embodiments, the simulation data does not include haptic information, and the processor may calculate haptic information from the simulation data as described in relation to FIG. 7.

FIG. 7 is a flowchart illustrating another embodiment of a method 732 of providing haptic simulation in an exercise device. The method 732 includes obtaining simulation data for a workout routine performed on an exercise device at 734, similar to or the same as described in relation to FIG. 6. In some embodiments, the simulation data is obtained from local hardware storage device. In some embodiments, the simulation data is obtained from a remote hardware storage device, such as by downloading or streaming the simulation data from a remote server or datacenter.

The method 732 may further include detecting a simulated object in the simulation video or video information at 742 and determining a movement of the simulated object in simulation video or video information at 744. In some embodiments, the simulated object is an object in the simulation video or video information that is analogous to a contact point of the exercise device. For example, the simulation video or video information may be a first-person perspective of a rider riding a mountain bike of a trail. The simulation video or video information may include the handlebars in the frame of the simulation video or video information, and a computing device or processor may detect the presence of the handlebars. In other examples, the simulation video or video information may include a running surface in the frame of the simulation video or video information, allowing the system to detect curbs, rocks, or roots in the video and simulate the running surface with actuators that move the tread belt.

The method 732 further includes displaying video information of the simulation data on a display (such as display 102 described in relation to FIG. 1) at 736. In some embodiments, the method 732 further includes playing audio information of the simulation data at 736. In some embodiments, the simulation data includes both audio information and video information. The audio and/or video information provides visual and/or auditory immersion to which the haptic simulation(s) add further immersion.

In some embodiments, the simulated object in the simulation video or video information is detected relative to a horizon or other reference point to measure the amount of displacement of the simulated object in the video. For example, the horizon may be a horizontal line that provides a consistent reference within the video. In other examples, the horizon is not visible in the video information and another relatively stationary object may be used. In at least one embodiment, the sun is approximated to be stationary in the sky for the purposes of measuring the amount of displacement of the simulated object in the video information. In some examples, the simulated object is measured relative to other stationary objects in the environment to measure the amount of movement. In at least one embodiment, the sun is approximated to be stationary in the sky for the purposes of measuring the amount of displacement of the simulated object in the video information. In some embodiments, the movement of the simulated object is determined by a machine learning (ML) that refines through iterations.

A machine learning model (ML model) according to the present disclosure refers to a computer algorithm or model (e.g., a classification model, a regression model, a language model, an object detection model) that can be tuned (e.g., trained) based on training input to approximate unknown functions. For example, a machine learning model may refer to a neural network or other machine learning algorithm or architecture that learns and approximates complex functions and generate outputs based on a plurality of inputs provided to the machine learning model. In some embodiments, a machine learning system, model, or neural network described herein is an artificial neural network. In some embodiments, a machine learning system, model, or neural network described herein is a convolutional neural network. In some embodiments, a machine learning system, model, or neural network described herein is a recurrent neural network. In at least one embodiment, a machine learning system, model, or neural network described herein is a Bayes classifier. As used herein, a "machine learning system" may refer to one or multiple machine learning models that cooperatively generate one or more outputs based on corresponding inputs. For example, a machine learning system may refer to any system architecture having multiple discrete machine learning components that consider different kinds of information or inputs.

The method 732 further includes actuating an actuator of the exercise device based on the determined movement of the simulated object in the simulation video or video information at 746, and the method 732 includes moving a frame of the exercise device relative to the base of the exercise device with the actuator at 740. In some embodiments, the frame is further movable relative to the base to change an inclination or declination of the exercise device.

Figure 8:
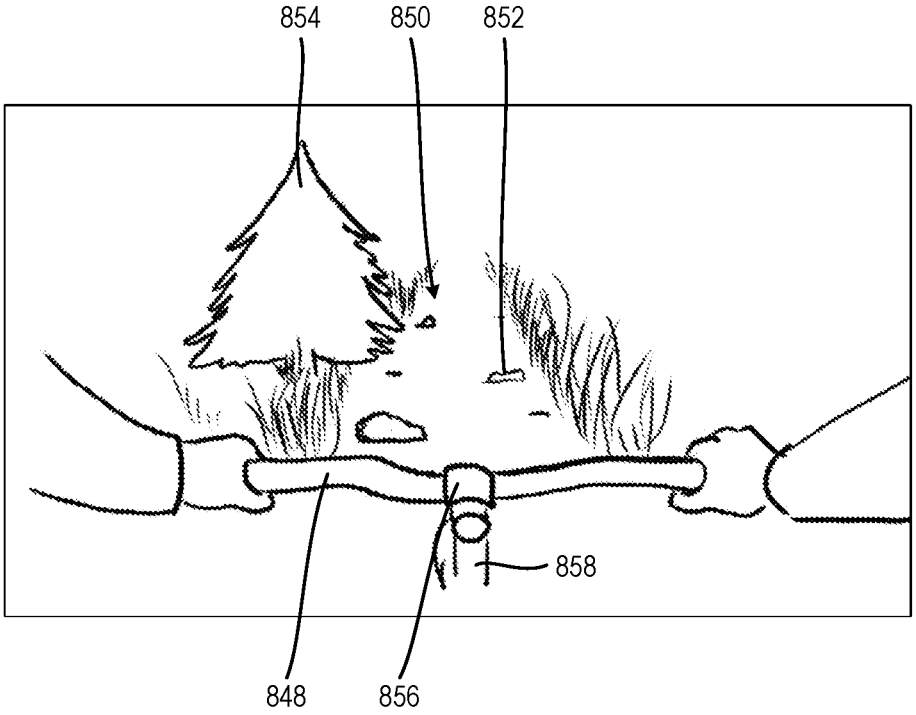
FIG. 8 is an example of a video that is analyzed to provide haptic simulation in an exercise device, according to at least one embodiment of the present disclosure.

An example of simulated object detection and image processing is illustrated in FIG. 8. The video information of FIG. 8 represents a mountain bike trail ride recorded by the user or another rider. The video information includes the handlebars 848 (which may be detected as a simulated object for determining haptic information for actuating the handlebars of the exercise device), the trail 850, trail surface features 852 (such as rocks and roots), and environmental objects 854 that may be used as reference points. In some embodiments, the system may detect the handlebars 848 through image recognition, edge detection, or other image processing techniques to identify the expected shape of either straight handlebars or drop handlebars. Because part or all of the handlebars 848 may be obscured or out of the video frame during portions of the video information. In some embodiments, the system may identify a stem 858, which connects the handlebars 848 to a frame of the bicycle as a proxy for the position and orientation of the handlebars 848.

In some embodiments, the handlebars 848 are a simulated object, and the system may determine the haptic information based on the position and movement of the handlebars 848 relative to one or more reference points, such as the trail 850, trail surface features 852, or other environmental objects 854. In some embodiments, the system may detect more than one simulated object to provide haptic simulation with a plurality of actuators. For example, the handlebars 848 in the video information may be detected and tracked to calculated haptic information used to actuate a first actuator (or actuators) associated with the handlebars of the exercise device, and trail surface features 852 may be detected and tracked to approximate the objects interacting with the rear wheel of the bicycle to provide haptic simulation for the saddle movement.

In at least one embodiment, a system or method according to the present disclosure allows for a user of an exercise device to be more immersed in a video or audio presentation during a workout routine. In some examples, simulation data includes haptic information that is coordinated to the video information and/or audio information. In some examples, the haptic information may be calculated by object detection or other image processing and recognition techniques to create immersive haptic simulation of conventional action camera videos.

INDUSTRIAL APPLICABILITY

The present disclosure relates generally to systems and methods for haptic simulations in an exercise device. More particularly, the exercise devices of the present disclosure include a frame that is movable relative to a base of the exercise device to increase the user's immersion in a simulated environment.

An exercise device is any mechanical device that is used to provide or replicate a physical activity in a localized space. Exercise devices can include a treadmill, cable or spring resistance machine, weight resistance machine, dumbbells, elliptical machine, stepper machine, stationary bicycle, rowing machine, or any other machine or exercise device. In an example, it should be understood that while a road bicycle may not be an exercise device, as used herein, a bicycle positioned on a stationary trainer device should be considered an exercise device as the bicycle remains in one location while the user rides the bicycle on the stationary trainer device.

In some embodiments, an exercise device includes or is in communication with a display. The display allows a user of the exercise device to view video information as the user engages in exercises. In some embodiments, the display presents video information that simulates a route, path, track, road, trail, or other environment associated with the activity replicated by the exercise device. For example, a display integrated in or in communication with a treadmill may present video information simulating traveling down a road in Oahu, Hawaii at a speed approximately equal to the speed at which the tread belt is moving on the treadmill. The resulting experience for the user is a simulated run down the road presented on the display. Similarly, in another example, a display integrated in or in communication with a stationary bicycle may present video information simulating traveling down a mountain trail in Sedona, Arizona at a speed approximately equal to the speed at which the user moves the pedals of the stationary bicycle. The resulting experience for the user is a simulated mountain bike ride down the trail presented on the display. In yet another example, a display integrated in or in communication with a rowing machine may present video information simulating rowing down the Charles River in Cambridge, Massachusetts at a speed approximately equal to the speed at which the user pulls the handle of the rowing machine. The resulting experience for the user is a simulated row down the river presented on the display.

The exercise device simulates the experience based on simulation data that includes video information as described above. In some embodiments, the simulation data includes audio information. For example, the exercise device may offer one or more simulations such as simulate racing in a stage of a bike race or running away from a dinosaur. In such examples, audio information can increase the immersion of a bike race simulation by simulating cheering fans or sound of another racer approaching from behind on a climb. In another example, audio information can increase the immersion of a dinosaur chase by simulating the roar of the dinosaur behind the runner.

In some embodiments, the simulation data includes haptic information. In the previous examples, the exercise device offers simulations that simulate racing in a stage of a bike race or running away from a dinosaur. In such examples, haptic information can increase the immersion of a bike race simulation by rapidly changing inclination of a frame of the exercise bicycle relative to a base of the exercise bicycle simulate the cobblestone road surface of the Paris-Roubaix bicycle race. In another example, haptic information can increase the immersion of the dinosaur chase by rapidly changing the inclination of the tread belt of the treadmill to simulate the ground shaking with the dinosaur footsteps.

The haptic information may be predetermined and stored on a hardware storage device with the video and/or audio information of the simulation data. In some embodiments, the haptic information may be calculated by the exercise device, a client device, or a workout server based on the video information. For example, a recorded video of a mountain bike ride from a rider's viewpoint (such as video information recorded by a GoPro® or other action camera) may include the bicycle handlebars within the frame of the video information. In some embodiments, the system detects the location of the handlebars in the video information and determines the movement of the handlebars relative to the trail surface. The movement of the handlebars may be presented to the exercise device as haptic information and allow the exercise device to simulate the movement of the handlebars in the video information by moving the handle bars of the stationary bicycle relative to a frame of the stationary bicycle.

In some embodiments, an exercise device is a stationary bicycle with a display integrated into the exercise device. In some embodiments, the display may be independent from, but in data communication with, the exercise device and receive video information from a computing device of the exercise device. The computing device includes a processor and a hardware storage device with instructions stored thereon that, when executed by the processor, cause the exercise device to perform any of the methods described herein.

In some embodiments, the hardware storage device is any non-transient computer readable medium that may store instructions thereon. The hardware storage device may be any type of solid-state memory; volatile memory, such as static random access memory (SRAM) or dynamic random access memory (DRAM); or non-volatile memory, such as read-only memory (ROM) including programmable ROM (PROM), erasable PROM (ERPOM) or EEPROM; magnetic storage media, such as magnetic tape; platen-based storage device, such as hard disk drives; optical media, such as compact discs (CD), digital video discs (DVD), Blu-ray Discs, or other optical media; removable media such as USB drives; non-removable media such as internal SATA or non-volatile memory express (NVMe) style NAND flash memory, or any other non-transient storage media. In some embodiments, the hardware storage device is local to and/or integrated with the computing device. In some embodiments, the hardware storage device is accessed by the computing device through a network connection.

The exercise device includes one or more contact points supported by a frame with which the user touches, contacts, or engages with the exercise device during the exercise. It should be understood that while the user may touch or contact one or more controls of the exercise device, such as a touchscreen of the display or other input devices to provide inputs to the computing device (e.g., volume controls, resistance levels, power buttons), the controls or input devices are not considered the contact points of the exercise device for the purposes of the exercise performed on the exercise device. In some embodiments, the exercise device is a stationary bicycle and the intended exercise of the stationary bicycle is cycling, therefor, the components of the stationary bicycle used for cycling are considered to be the contact points of the exercise device. The contact points of the exercise device include the handlebars, the saddle, and the pedals.

In some embodiments, the frame moves relative to a base at a pivot. By moving the frame relative to the base, the exercise device can provide haptic feedback and/or simulations to the user by moving one or more contact points of the exercise device. In some embodiments, the contact points all move together to simulate, for example, a bicycle moving over a surface. In other embodiments, at least one contact point moves relative to another contact point, such as moving handlebars relative to a seat or saddle. In some embodiments, the rotation of the frame around the pivot can simulate cobblestones, washboard roads, mountain bike trails, etc. on an exercise bicycle. In other embodiments, the rotation of the frame can simulate other real-world experiences for other exercise devices, such as rough water on a stationary rower exercise device or rocky running trails on a treadmill exercise device.

In some embodiments, the frame is movable relative to the base by one or more incline motors. The incline motor applies a torque around the pivot to rotate the frame relative to the base. In some embodiments, the incline motor includes gears, worm gears, pinions, etc. to mechanically apply the torque around the pivot. In some embodiments, the incline motor includes a piston-and-cylinder with a pressurized fluid therein to apply pneumatically or hydraulically apply the torque around the pivot. In some embodiments, the incline motor includes an electromagnetic motor to move the frame relative to the base.

The incline motor(s) is in data communication with the computing device to move the frame relative to the base in response to simulation data. In some embodiments, the computing device has stored thereon instruction that, when executed by the computing device, cause the exercise device to perform any of the methods described herein. In some embodiments, the computing device 104 communicates with the incline motor to move the frame relative to the base by moving at least a portion of the incline motor at a rate of 5 millimeters per second. In contrast to conventional incline motors, an incline, motor according to the present disclosure, is configured to move the frame rapidly and for a period of time at least 5 seconds in duration. For example, a conventional incline motor moves the frame relative to the base slowly and smoothly to provide gradual changes in inclination of the running surface (e.g., treadmill) or inclination of a bicycle frame to replicate riding a hill. However, there is no mechanism by which a conventional incline motor produces rapid, sustained movement to provide haptic simulations to a user.

In some embodiments, a treadmill exercise device has a display and computing device in communication therewith to provide exercise routines and video information to a user. The exercise device has a tread belt supported by a frame that is movable relative to a base of the exercise device. As described herein, the computing device may move the frame, and, hence, contact points such as the tread belt, relative to the base to produce a haptic simulation for the user. In some embodiments, the frame is movable relative to the base around a pivot by an incline motor. In some embodiments, the incline motor is used to provide haptic simulation through rapid and/or sustained movement of the frame. In other embodiments, the incline motor provides slow and/or smooth changes in the inclination of the frame relative to the base to simulate overall angle of a running surface, while an actuator is additionally provided to move the frame relative to the base.

In some embodiments, the actuator is connected to the incline motor, as will be described in greater detail herein, to move the frame relative to the incline motor (or move the frame and incline motor relative to the base). For example, the incline motor and actuator may be connected in sequence to allow the incline motor to provide macro changes in the position of the frame relative to the base, while the actuator provides smaller, but more rapid, changes in the position of the frame relative to the base.

In some embodiments, the exercise device includes a single actuator. In other embodiments, the exercise device includes a plurality of actuators. Each of the actuators can include one or more individual actuatable devices, such as including a pair of actuatable devices to allow movement of the frame in one or more directions or axes relative to the base. In some embodiments, the actuators are electromagnetic actuators that use permanent magnets, electromagnets, or combinations thereof to apply magnetic force to move the frame in one or more directions or axes relative to the base. In some embodiments, the actuators are fluid piston actuators that use compressible or incompressible fluid in a cylinder to apply a force to a piston that is slidable relative to the cylinder. The fluid may be a gas (e.g., pneumatic piston and cylinder) or a liquid (e.g., hydraulic piston and cylinder) that moves piston relative to the cylinder to move the frame in one or more directions or axes relative to the base. In some embodiments, the actuators are mechanical actuators that use gears, springs, elastic or biasing elements, or combinations thereof to apply a compression and/or tension force to move the frame in one or more directions or axes relative to the base.

In different embodiments, the actuators move the contact points in different path directions and/or shapes. In some embodiments, an actuator moves the frame around the pivot relative to the base to move at least a portion of the tread belt in an arcuate path. In other embodiments, the actuator can move the frame in a linear path relative to the base. For example, one or more actuators may move the frame vertically. In another example, one or more actuators may move the frame horizontally.

The actuators move in response to the simulation data provided by the computing device. The simulation data includes haptic information that instructs one or more actuators to move a contact point coordinated with audio and/or video information of the simulation data that is presented to the user on the display or other audiovisual devices (e.g., speakers or headphones). The haptic information may include instructions for one or more actuators to move the frame a nominal or relative (to a total range of motion) amount, at a particular speed, for a particular duration, or combination thereof.

For example, the haptic information may instruct the actuator to move the tread belt in coordination with a tree stump presented on the display. The haptic information may instruct the actuator at a 3:26 timestamp to translate the tread belt upward by 35 millimeters (mm) at a rate of 100 millimeters per second (mm/s) and return the tread belt to the original position at a rate of 50 mm/s. The higher rate of upward travel and the lower rate of downward travel may replicate an asymmetry of the tree stump in the video information.

In other examples, the entire surface of the tread belt may displace upward before returning to the original position to simulate an explosion in the video information presented on the display. In at least one example, the exercise device may simulate an action scene and prompt the user of the exercise device to run to safety by evading objects and/or clearing obstacles in the presented video and/or audio information. The action scene may simulate escaping a boobytrapped temple where the user must run along uneven pathways, crumbling walls, and escape a large boulder following the user. The actuator(s) may move the frame around the pivot to simulate the debris from the walls on the running surface and simulate the shaking of the ground as the boulder rolls behind the user.

In some embodiments, an actuator and incline motor are connected in sequence to provide a cumulative displacement of a frame relative to a base.

The range of motion of the actuator and a range of motion of the connection point of the frame movable by the actuator may be different. For example, the actuator may be connected to the frame (e.g., the actuator that moves the frame) by being coupled to a linkage or lever that moves the frame. In other examples, the range of motion of the actuator and a range of motion of the frame movable by the actuator may be equal, as the actuator and the frame are directly coupled to one another.

In some embodiments, the incline motor has a range of motion that is greater than the actuator. In some embodiments, the actuator moves the frame relative to the base faster than the incline motor.

In some embodiments, the range of motion of the frame is in a range having an upper value, a lower value, or upper and lower values including any of 5 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, or any values therebetween. In some examples, the range of motion of the connection point is greater than 5 mm. In other examples, the range of motion of the connection point is less than 100 mm. In yet other examples, the range of motion of the connection point is between 5 mm and 100 mm. In yet other examples, the range of motion of the connection point is between 10 mm and 80 mm. In yet other examples, the range of motion of the connection point is about 50 mm.

In some embodiments, the maximum rate of motion of the connection point of the frame is in a range having an upper value, a lower value, or upper and lower values including any of 25 mm/s, 50 mm/s, 100 mm/s, 150 mm/s, 200 mm/s, 250 mm/s, 300 mm/s, 350 mm/s, 400 mm/s, 450 mm/s, 500 mm/s, 550 mm/s, 600 mm/s, 650 mm/s, 700 mm/s, 750 mm/s, 800 mm/s, 850 mm/s, 900 mm/s, 950 mm/s, 1000 mm/s, or any values therebetween. In some examples, the maximum rate of motion of the connection point is greater than 25 mm/s. In other examples, the maximum rate of motion of the connection point is less than 1000 mm/s. In yet other examples, the maximum rate of motion of the connection point is between 25 mm/s and 1000 mm/s. In yet other examples, the maximum rate of motion of the connection point is between 100 mm/s and 750 mm/s. In yet other examples, the maximum rate of motion of the connection point is greater than 500 mm/s.

In some embodiments, the actuator moves the frame relative to the base faster than the incline motor, and the incline motor has a larger range of motion than the actuator. As described herein, in some embodiments, the actuator includes a magnetic actuator, such as a linear magnetic actuator or rotational magnetic actuator. In some embodiments, the actuator includes a piston-and-cylinder actuator, such as a hydraulic or pneumatic piston-and-cylinder actuator. In some embodiments, the actuator includes a mechanical actuator, such as a rack and pinion actuator.

In at least one embodiment, the incline motor has a heat sink that allows the incline motor to move the frame relative to the base faster or for longer durations than a conventional heat sink. In some embodiments, the heat sink is an active heat sink with active cooling, such as a fan, liquid cooling, a thermoelectric cooler (e.g., a Peltier-style cooler), or other active cooling mechanisms. In some embodiments, the heat sink is a passive heat sink, such as cooling fins, pins, rods, heat spreaders, vapor chambers, heat pipes, or other heat sinks that increase surface area and passively exhaust heat to the ambient atmosphere.

In some embodiments, the incline motor heat sink is configured to allow the incline motor to operate at least at a 50% duty cycle. In some embodiments, the incline motor heat sink is configured to allow the incline motor to operate at least at a 90% duty cycle. In some embodiments, the incline motor heat sink is configured to allow the incline motor to operate at a 100% duty cycle.

In some embodiments, the incline motor heat sink is configured to dissipate at least 500 Watts per minute (W/min). In some embodiments, the incline motor heat sink is configured to dissipate at least 750 Watts per minute (W/min). In some embodiments, the incline motor heat sink is configured to dissipate at least 1000 Watts per minute (W/min).

In some embodiments, the exercise device includes an incline motor, and, optionally, an actuator, configured to move a frame of the exercise device relative to a base. The incline motor and/or actuator may move the frame according to haptic information provided by the computing device. In some embodiments, the frame is movable (e.g., tiltable) relative to a base that contacts the ground. In some embodiments, the video information or workout routine includes global positioning satellite (GPS) location information or other location information. The location information may be compared to elevation or profile maps to determine an inclination or declination of the road or trail to be simulated by the tilt of the frame. The frame may connect to the base at a rotational pivot that allows the frame supporting the contact points to move relative to the ground. In some examples, an incline motor provides macro-movements of the frame around the pivot to allow the exercise device to simulate the angle of climbing up a road, while the incline motor and actuator provides smaller movements for haptic simulation to simulate the surface condition of the road. The computing device may be in data communication with the actuator(s) and incline motor to tilt the frame to provide a more immersive simulation.

While the movable frame relative to the base is described herein in relation to an exercise bicycle, it should be understood that a tiltable or movable frame with haptic simulation, where the frame is movable relative to a base, is applicable to other types of exercise devices, such as treadmills, rowing machines, and other devices.

An exercise device, according to the present disclosure, may include a plurality of electronic components in data communication. In some embodiments, the electronic system includes a processor and a hardware storage device. In some embodiments, the hardware storage device is any non-transient computer readable medium that may store instructions thereon. The hardware storage device may be any type of solid-state memory; volatile memory, such as static random access memory (SRAM) or dynamic random access memory (DRAM); or non-volatile memory, such as read-only memory (ROM) including programmable ROM (PROM), erasable PROM (ERPOM) or EEPROM; magnetic storage media, such as magnetic tape; platen-based storage device, such as hard disk drives; optical media, such as compact discs (CD), digital video discs (DVD), Blu-ray Discs, or other optical media; removable media such as USB drives; non-removable media such as internal SATA or non-volatile memory express (NVMe) style NAND flash memory, or any other non-transient storage media. In some embodiments, the hardware storage device is local to and/or integrated with the processor. In some embodiments, the hardware storage device is accessed by the processor through a network connection.

The processor is further in communication with a display controller. The processor receives simulation data from the hardware storage device. In some embodiments, the simulation data includes video information and haptic information. The processor transmits video information to the display controller and instructions based on the haptic information to the incline motor and/or the actuator. The display controller communicates with the display to present the video information to a user, while the incline motor and/or the actuator moves the frame of the exercise device relative to the base to provide haptic simulation to the user. The processor may coordinate the presentation of the video information and haptic information to the user such that the user perceives the exercise device moving in coordination with the displayed video. In some embodiments, the processor is further in communication with the one or more sensors and/or cameras to monitor the position and/or movement of the user. The processor may transmit instructions or one or more actuators of a plurality of actuators based on the measurements from the sensors and/or cameras.

In some embodiments, a method of providing haptic simulation in an exercise device includes obtaining simulation data for a workout routine performed on an exercise device. In some embodiments, the simulation data is obtained from local hardware storage device. In some embodiments, the simulation data is obtained from a remote hardware storage device, such as by downloading or streaming the simulation data from a remote server or datacenter. A workout routine is a predetermined set of instructions that may be provided to a user. Following the workout routine can guide, entertain, or encourage the user through one or more exercises to produce workout information. The workout routine may include haptic information, video information, audio information, text information, still images, or combinations thereof to communicate the workout routine to the user.

The method further includes displaying video information of the simulation data on a display. In some embodiments, the method further includes playing audio information of the simulation data at. In some embodiments, the simulation data includes both audio information and video information. The audio and/or video information provides visual and/or auditory immersion to which the haptic simulation(s) add further immersion.

The haptic information of the simulation data is used in actuating an incline motor (and, optionally, an actuator) of the exercise device, and the method includes moving a frame of the exercise device relative to a base of the exercise device with incline motor (and, optionally, actuator). In some embodiments, the frame is further movable relative to the base to change an inclination or declination of the exercise device.

While the method includes actuating an actuator of the exercise device based on the simulation data, in some embodiments, the simulation data does not include haptic information, and the processor may calculate haptic information from the simulation data as described herein.

In some embodiments, a method of providing haptic simulation in an exercise device includes obtaining simulation data for a workout routine performed on an exercise device, similar to or the same as described herein. In some embodiments, the simulation data is obtained from local hardware storage device. In some embodiments, the simulation data is obtained from a remote hardware storage device, such as by downloading or streaming the simulation data from a remote server or datacenter.

The method may further include detecting a simulated object in the simulation video or video information and determining a movement of the simulated object in simulation video or video information. In some embodiments, the simulated object is an object in the simulation video or video information that is analogous to a contact point of the exercise device. For example, the simulation video or video information may be a first-person perspective of a rider riding a mountain bike of a trail. The simulation video or video information may include the handlebars in the frame of the simulation video or video information, and a computing device or processor may detect the presence of the handlebars. In other examples, the simulation video or video information may include a running surface in the frame of the simulation video or video information, allowing the system to detect curbs, rocks, or roots in the video and simulate the running surface with actuators that move the tread belt.

The method further includes displaying video information of the simulation data on a display. In some embodiments, the method further includes playing audio information of the simulation data. In some embodiments, the simulation data includes both audio information and video information. The audio and/or video information provides visual and/or auditory immersion to which the haptic simulation(s) add further immersion.

In some embodiments, the simulated object in the simulation video or video information is detected relative to a horizon or other reference point to measure the amount of displacement of the simulated object in the video. For example, the horizon may be a horizontal line that provides a consistent reference within the video. In other examples, the horizon is not visible in the video information and another relatively stationary object may be used. In at least one embodiment, the sun is approximated to be stationary in the sky for the purposes of measuring the amount of displacement of the simulated object in the video information. In some examples, the simulated object is measured relative to other stationary objects in the environment to measure the amount of movement. In at least one embodiment, the sun is approximated to be stationary in the sky for the purposes of measuring the amount of displacement of the simulated object in the video information. In some embodiments, the movement of the simulated object is determined by a machine learning (ML) that refines through iterations.

A machine learning model (ML model) according to the present disclosure refers to a computer algorithm or model (e.g., a classification model, a regression model, a language model, an object detection model) that can be tuned (e.g., trained) based on training input to approximate unknown functions. For example, a machine learning model may refer to a neural network or other machine learning algorithm or architecture that learns and approximates complex functions and generate outputs based on a plurality of inputs provided to the machine learning model. In some embodiments, a machine learning system, model, or neural network described herein is an artificial neural network. In some embodiments, a machine learning system, model, or neural network described herein is a convolutional neural network. In some embodiments, a machine learning system, model, or neural network described herein is a recurrent neural network. In at least one embodiment, a machine learning system, model, or neural network described herein is a Bayes classifier. As used herein, a "machine learning system" may refer to one or multiple machine learning models that cooperatively generate one or more outputs based on corresponding inputs. For example, a machine learning system may refer to any system architecture having multiple discrete machine learning components that consider different kinds of information or inputs.

The method further includes actuating an actuator of the exercise device based on the determined movement of the simulated object in the simulation video or video information, and the method includes moving a frame of the exercise device relative to the base of the exercise device with the actuator. In some embodiments, the frame is further movable relative to the base to change an inclination or declination of the exercise device.

In an example, a provided video information represents a mountain bike trail ride recorded by the user or another rider. The video information includes the handlebars (which may be detected as a simulated object for determining haptic information for actuating the handlebars of the exercise device), the trail, trail surface features (such as rocks and roots), and environmental objects that may be used as reference points. In some embodiments, the system may detect the handlebars through image recognition, edge detection, or other image processing techniques to identify the expected shape of either straight handlebars or drop handlebars. Because part or all of the handlebars may be obscured or out of the video frame during portions of the video information. In some embodiments, the system may identify a stem, which connects the handlebars to a frame of the bicycle as a proxy for the position and orientation of the handlebars.

In some embodiments, the handlebars are a simulated object, and the system may determine the haptic information based on the position and movement of the handlebars relative to one or more reference points, such as the trail, trail surface features, or other environmental objects. In some embodiments, the system may detect more than one simulated object to provide haptic simulation with a plurality of actuators. For example, the handlebars in the video information may be detected and tracked to calculated haptic information used to actuate a first actuator (or actuators) associated with the handlebars of the exercise device, and trail surface features may be detected and tracked to approximate the objects interacting with the rear wheel of the bicycle to provide haptic simulation for the saddle movement.

In at least one embodiment, a system or method according to the present disclosure allows for a user of an exercise device to be more immersed in a video or audio presentation during a workout routine. In some examples, simulation data includes haptic information that is coordinated to the video information and/or audio information. In some examples, the haptic information may be calculated by object detection or other image processing and recognition techniques to create immersive haptic simulation of conventional action camera videos.

The present disclosure relates to systems and methods for haptic simulation according to at least the examples provided in the sections below:

[A1] In some embodiments, a haptic simulation exercise device includes a frame, a base supporting the frame with at least one pivot point between the frame and the base, and an actuator configured to displace the frame relative to the base around the pivot point.

[A2] In some embodiments, the actuator of [A1] is connected to the base and the frame and positioned between the base and the frame.

[A3] In some embodiments, the actuator of [A1] or [A2] is an electromagnetic actuator.

[A4] In some embodiments, the actuator of [A1] or [A2] is a fluid piston actuator.

[A5] In some embodiments, the actuator of [A1] or [A2] is a mechanical actuator.

[A6] In some embodiments, the frame of any of [A1] to [A5] supports a tread belt.

[A7] In some embodiments, the frame of any of [A1] to [A5] supports a handlebar.

[A8] In some embodiments, the frame of any of [A1] to [A5] supports a saddle.

[A9] In some embodiments, the exercise device of any of [A1] through [A8] includes an incline motor configured to incline the frame relative to the base. The actuator is coupled to the incline motor to displace one of the frame and base relative to the incline motor.

[A10] In some embodiments, the incline motor of [A9] has a greater range of motion than the actuator.

[A11] In some embodiments, the incline motor of [A9] or [A10] is configured to move the frame with a greater velocity relative to the base than the actuator.

[A12] In some embodiments, the incline motor of any of [A9] through [A11] has a range of motion of at least 10 cm.

[A13] In some embodiments, the incline motor of any of [A9] through [A12] has a heatsink configured to dissipate at least 500 Watts per minute.

[A14] In some embodiments, the heatsink of [A13] includes a passive cooling feature.

[A15] In some embodiments, the heatsink of [A13] includes a vapor chamber.

[A16] In some embodiments, the heatsink of [A13] includes an active cooling feature.

[B1] In some embodiments, a method of haptic simulation for an exercise device includes obtaining simulation data for a workout routine performed on an exercise device, displaying video information of the simulation data on a display, actuating an incline motor of the exercise device based on the simulation data, and displacing a frame of the exercise device relative to a base of the exercise device at least 5 millimeters in no more than one second based at least partially on the simulation data.

[B2] In some embodiments, the simulation data of [B1] includes haptic information.

[B3] In some embodiments, the display of [B1] or [B2] is integrated with the exercise device.

[B4] In some embodiments, the exercise device of any of [B1] through [B3] includes an actuator, and displacing the frame includes providing instructions to the actuator to rotate the frame relative to the base at a pivot point.

[B5] In some embodiments, the exercise device of any of [B1] through [B3] includes an incline motor and an actuator, and displacing the frame includes providing instructions to the actuator and incline motor to rotate the frame relative to the base at a pivot point.

[B6] In some embodiments, the simulation data of any of [B1] through [B5] includes surface profile haptic information, and the incline motor moves the frame relative to the based to simulate a surface in the video information.

[B7] In some embodiments, the method of [B6] further includes tilting the frame with an incline motor based on GPS information.

[B8] In some embodiments, the method of any of [B1] through [B7] further includes determining haptic information from the video information of the simulation data.

[B9] In some embodiments, determining the haptic information of [B8] includes detecting a simulated object in video information of the simulation data, and determining a movement of the simulated object in the video information.

[B10] In some embodiments, detecting a simulated object in [B9] includes detecting one or more edges of the simulated object relative to a horizon.

[B11] In some embodiments, determining a movement of the simulated object in [B9] includes measuring a speed of the simulated object toward a viewpoint of the video information.

[C1] In some embodiments, a system for haptic simulation with an exercise device includes a frame, a base, an incline motor, a display, and a computing device. The based is configured to support the frame and allow rotation of the frame relative to the base of the exercise device, and the incline motor is configured to displace the frame relative to the base. The computing device is in data communication with the incline motor and the display. The computing device provides instructions to the incline motor based on simulation data accessed by a processor of the computing device.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the scope of the present disclosure, and that various changes, substitutions, and alterations may be made to embodiments disclosed herein without departing from the scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A haptic simulation exercise device comprising:

a frame;

a base supporting the frame with at least one pivot point between the frame and the base;

an incline motor configured to provide a first change to an incline of the frame relative to the base; and an actuator coupled to the incline motor, the actuator configured to provide a second change to a position of the base or the frame relative to the base.

2. The haptic simulation exercise device of claim 1, wherein the incline motor has a greater range of motion than the actuator.

3. The haptic simulation exercise device of claim 1, wherein the actuator is configured to move the frame faster than the incline motor.

4. The haptic simulation exercise device of claim 1, wherein the incline motor has a range of motion of at least 10 cm.

5. The haptic simulation exercise device of claim 1, wherein the incline motor has a heatsink configured to dissipate at least 500 Watts per minute.

6. The haptic simulation exercise device of claim 5, wherein the heatsink includes a passive cooling feature.

7. The haptic simulation exercise device of claim 6, wherein the heatsink includes a vapor chamber.

8. The haptic simulation exercise device of claim 5, wherein the heatsink includes an active cooling feature.

9. The haptic simulation exercise device of claim 1, wherein the second change to the position of the base or the frame relative to the base comprises an additional incline of the frame relative to the base.

10. The haptic simulation exercise device of claim 1, wherein the second change to the position of the base or the frame relative to the base comprises a linear translation of the base or the frame relative to the base.

* * * * *